US007826783B2

(12) United States Patent
Miyamoto et al.

(10) Patent No.: US 7,826,783 B2
(45) Date of Patent: Nov. 2, 2010

(54) IMAGE FORMING APPARATUS AND IMAGE FORMING METHOD

(75) Inventors: Hidetoshi Miyamoto, Osaka (JP); Kouji Uno, Osaka (JP); Masaki Kadota, Osaka (JP)

(73) Assignee: Kyocera Mita Corporation (JP)

( * ) Notice: Subject to any disclaimer, the term of this patent is extended or adjusted under 35 U.S.C. 154(b) by 345 days.

(21) Appl. No.: 12/033,319

(22) Filed: Feb. 19, 2008

(65) Prior Publication Data

US 2008/0205947 A1 Aug. 28, 2008

(30) Foreign Application Priority Data

Feb. 28, 2007 (JP) ..... 2007-048794

(51) Int. Cl.
*G03G 15/01* (2006.01)
*G03G 15/20* (2006.01)
*G03G 15/00* (2006.01)

(52) U.S. Cl. ..... 399/302; 399/308; 399/159; 399/162

(58) Field of Classification Search ..... 399/302, 399/308, 159, 162
See application file for complete search history.

(56) References Cited

U.S. PATENT DOCUMENTS 7,142,801 B2 * 11/2006 Kitani et al. ..... 399/302
7,308,213 B2 * 12/2007 Sudo et al. ..... 399/51
2005/0063739 A1 * 3/2005 Kobayashi et al. ..... 399/299
2006/0204263 A1 * 9/2006 Watanabe ..... 399/66
2006/0204289 A1 * 9/2006 Murase et al. ..... 399/302
2006/0210327 A1 * 9/2006 Iwakura et al. ..... 399/313
2008/0019741 A1 * 1/2008 Lee et al. ..... 399/302

FOREIGN PATENT DOCUMENTS

JP 2001-350347 12/2001

* cited by examiner

*Primary Examiner*—David P Porta
*Assistant Examiner*—Mindy Vu
(74) *Attorney, Agent, or Firm*—Gerald E. Hespos; Michael J. Porco

(57) ABSTRACT

An image forming device includes an image support body on which an electrostatic latent image is formed. A developer develops the electrostatic latent image on the image support body with a toner to form a toner image. The toner image on the image support body is transferred to an intermediate transfer belt. A primary transferee transfers the toner image on the image support body onto the intermediate transfer belt, and a secondary transferee transfers the toner image on the intermediate transfer belt onto paper. The image support body and the primary transferee are offset. A volume resistance of the intermediate transfer belt is adjusted to a value within the range of $1\times10^{7}$ to $1\times10^{11}$ Ω·cm and a surface resistance of the intermediate transfer belt is adjusted to a value within the range of $1\times10^{8}$ to $1\times10^{12}$ Ω/□.

11 Claims, 5 Drawing Sheets

IMAGE FORMING APPARATUS AND IMAGE FORMING METHOD

BACKGROUND OF THE INVENTION

1. Field of the Invention

The present invention relates to an image forming device and an image forming method. In particular, the invention relates to an image forming device of a system of transferring a toner image formed on an image support body to a recording medium via an intermediate transfer body and an image forming method using the image forming device.

2. Description of the Related Art

Conventionally, as an image forming method by an image forming device such as a copying machine and a printer using an electrophotographic system, a method is known in which a toner image formed on a photoconductor drum serving as an image support body is once primarily transferred onto an intermediate transfer belt and then the toner image on the intermediate transfer belt is again secondarily transferred onto a recording medium to form an image. It is known that use of this method leads to the advantage that it is possible to suppress transfer failure and generation of a shift of color registration due to many factors such as holding states of recording media and surface properties.

Here, the toner image transferred on the intermediate transfer belt, regardless of the photoconductor drum being a tandem type or a one drum type, is made to pass between the photoconductor drum and the transfer roll of the intermediate transfer belt in a plurality of times. At this time, the surface of the intermediate transfer belt and the toner image are friction charged, the charging amount of the toner on the intermediate transfer belt is varied, and it is revealed that the electrostatic adsorption force between the transferred toner and the intermediate transfer belt is changed. In other words, an electrostatic adsorption force is expected to be generated between the toner and the intermediate transfer belt.

Because of this, it has been found that the electrostatic adsorption force between the toner and the intermediate transfer belt becomes greatly different and the secondary transferarability of the toner image becomes extremely different.

Accordingly, in a resin belt used in color image forming devices of a tandem system, etc, electroconductive seamless belts provided with good strength, particularly good bending durability have been proposed (e.g., Patent Document 1). More specifically, proposed is an electroconductive seamless belt for transferring of a tandem system, in which a recording medium held by electrostatic adsorption is circularly driven by a driving member, and delivered to four kinds of image forming materials, and then each toner image is transferred to the recording medium in order. In this electroconductive seamless belt, a thermoplastic polyamide and a polymer-alloy resin comprising a thermoplastic polyamide and a thermoplastic elastomer are employed. [Patent Document 1] JP2001-350347A (Claims, and FIGS. 2 and 3)

However, in the color image forming device of JP2001-350347A, only the volume resistance of an electroconductive seamless belt is specified and no description is given for surface resistance. Therefore, a toner cannot be effectively transferred to an intermediate transfer belt in some cases. In other words, in some cases, the largest pressurization point of the primary transfer roller to the intermediate transfer belt may be shifted from the largest pressurization point of the photoconductor drum to the intermediate transfer belt. That is, in the case of offset placement, so as not to apply an excessive pressure to the intermediate transfer belt, an electric current needs to be flowed via the surface of the electroconductive seamless belt, and the problem of doing so being difficult is created.

Hence, in the color image forming device of JP2001-350347A, particularly in the case of using a positively charged toner, a problem is posed in that a toner cannot be effectively transferred to the intermediate transfer belt.

Furthermore, where a positively charged toner is used, when a toner transferred on the intermediate transfer belt is made to pass through a primary transfer position in a plurality of times, an outermost surface layer of the toner image transferred on the intermediate transfer belt is affixed to the photoconductor drum and thus peeled. As a result, there is a problem in that coming off of the center of the line image of the toner image on the intermediate transfer belt, i.e., "central fade-out" is liable to occur.

SUMMARY OF THE INVENTION

Thus, the inventors of the present invention have diligently studied and found that when a volume resistance and a surface resistance of an intermediate transfer belt are adjusted in a predetermined range, a toner can be effective transferred onto the intermediate transfer belt and also excellent transferability to paper can be achieved even where a photoconductor drum and a primary transfer roller are offset placed, having led to the completion of the present invention.

In other words, an object of the present invention is to provide an image forming device excellent in toner transferability even where a photoconductor drum and a primary transfer roller are offset placed, and an image forming method using the device.

According to one aspect of the present invention, there is provided an image forming device including: an image support body on which an electrostatic latent image is formed; a developer which develops the electrostatic latent image formed on the image support body with a toner to form a toner image; an intermediate transfer belt onto which the toner image formed on the image support body is transferred; a primary transfer means for transferring the toner image on the image support body onto the intermediate transfer belt; and a secondary transfer means for transferring the toner image on the intermediate transfer belt onto paper, the image support body and the primary transfer means being offset placed, wherein a volume resistance of the intermediate transfer belt is adjusted to a value within the range of $1\times10^{7}$ to $1\times10^{11}$ $\Omega\cdot$cm and a surface resistance of the intermediate transfer belt is adjusted to a value within the range of $1\times10^{8}$ to $1\times10^{12}$ $\Omega/\square$ (i.e., ohms per square), thereby being capable of solving the above-described problems.

In other words, in this manner, controlling the volume resistance and the surface resistance of the intermediate transfer belt to be a value within a predetermined range enables a toner to be stably transferred onto the intermediate transfer belt, even if a photoconductor drum serving as the image support body and a primary transfer roller serving as the primary transfer means are configured so as to be offset placed.

In addition, the photoconductor drum and the primary transfer roller are offset placed. With this configuration, when a toner is transferred onto the intermediate transfer belt, an excessive pressure is avoided to be applied in a short time and also a linear speed difference can be imparted to the intermediate transfer belt and the surface of the photoconductor drum in a primary transfer region, so that the generation of the central fade-out can be effectively restrained. As a result, the image forming device without generating an image defect can be provided.

Moreover, upon constructing the image forming device of the present invention, assuming that R1 denotes the volume resistance of the intermediate transfer belt and R2 denotes the surface resistance of the intermediate transfer belt, a numerical value represented by R1/R2 is preferably adjusted to a value within the range of from 0.01 to 100 (Ω·cm/(Ω/□)).

In this way, controlling the ratio of the volume resistance of the intermediate transfer belt (R1 (Ω·cm)) to the surface resistance of the intermediate transfer belt (R2 (Ω/□)) enables a toner to be further stably transferred onto the intermediate transfer belt between the photoconductor drum and the primary transfer roller.

Furthermore, upon constructing the image forming device of the present invention, when a toner is transferred, the current flowing between the photoconductor drum and the primary transfer roller is preferably adjusted to a value within the range of from 0.1 to 50 μA.

In this manner, controlling a current value flowing from the transfer roller to the photoconductor drum makes it possible for a toner to be stably transferred to the intermediate transfer belt.

Additionally, monitoring the current value can lead to quantitative control of the transferability of a toner to the intermediate transfer belt.

In addition, upon constructing the image forming device of the present invention, a modulus of elasticity of the intermediate transfer belt is preferably adjusted to a value within the range of from $1\times10^{1}$ to $1\times10^{3}$ MPa.

In this manner, controlling the modulus of elasticity of the intermediate transfer belt to be in a predetermined range enables the stable control of the durability of the intermediate transfer belt, the transferability of a toner and further the fixing property of a toner.

Furthermore, upon constructing the image forming device of the present invention, a surface roughness (Rz) of the intermediate transfer belt is preferably adjusted to a value within of less than 1.5 μm.

In this way, controlling the surface roughness (Rz) of the intermediate transfer belt to be in a predetermined range enables the stable control of the durability of the intermediate transfer belt, the transferability of a toner and further the fixing property of a toner.

Moreover, monitoring the surface roughness (Rz) of the intermediate transfer belt makes it possible to determine the abrasion state of the intermediate transfer belt to thereby set a standard for determination of its change time.

In addition, upon constructing the image forming device of the present invention, a thickness of the intermediate transfer belt is preferably adjusted to a value within the range of from 50 to 200 μm.

In this manner, controlling the thickness of the intermediate transfer belt to be in a predetermined range enables the stable control of the durability of the intermediate transfer belt, the transferability of a toner and further the fixing property of a toner.

Additionally, upon constructing the image forming device of the present invention, the intermediate transfer belt is constituted by a resin composition including a polyamide resin, a thermoplastic elastomer and an electroconductive material. Also, an addition quantity of the thermoplastic elastomer is preferably adjusted to a value within the range of from 10 to 150 parts by weight based on 100 parts by weight of the polyamide resin and an addition quantity of the electroconductive material is adjusted to a value within the range of from 0.1 to 100 parts by weight based on the amount of resin composition.

In this manner, controlling the configuration materials of the intermediate transfer belt to be in predetermined ranges enables not only the durability of the intermediate transfer belt to be good, but the charging property, electroconductivity, etc to be readily adjusted. As a result, the transferability of a toner can be stably controlled.

Moreover, upon constructing the image forming device of the present invention, the thermoplastic elastomer is preferably a polyamide thermoplastic elastomer.

In this manner, the use of a polyamide thermoplastic elastomer as the thermoplastic elastomer improves its compatibility with a polyamide resin and the durability of the intermediate transfer belt, and also further readily adjusts the charging property and the electroconductivity, etc.

In addition, upon constructing the image forming device of the present invention, the resin composition preferably contains a compatibilizing agent between a polyamide resin and a thermoplastic elastomer.

In this manner, the use of a compatibilizing agent improves the compatibility between a polyamide resin and a thermoplastic elastomer and the durability of the intermediate transfer belt, and also further readily adjusts the charging property and the electroconductivity, etc.

Moreover, upon constructing the image forming device of the present invention, the photoconductor drum is preferably an amorphous silicon drum.

The configuration in this way can improve the durability of the photoconductor drum.

Furthermore, upon constructing the image forming device of the present invention, the toner is preferably a positively charged toner.

The configuration in this manner can further effectively restrain the generation of the central fade-out.

According to another aspect of the present invention, there is provided an image forming method in an image forming device including: an image support body on which an electrostatic latent image is formed; a developer which develops the electrostatic latent image formed on the image support body with a toner to form a toner image; intermediate transfer belt onto which the toner image formed on the image support body is transferred; a primary transfer means for transferring the toner image on the image support body onto the intermediate transfer belt; and a secondary transfer means for transferring the toner image on the intermediate transfer belt onto paper, the image support body and the primary transfer means being offset placed, wherein a volume resistance of the intermediate transfer belt is adjusted to a value within the range of from $1\times10^{7}$ to $1\times10^{11}$ Ω·cm and a surface resistance of the intermediate transfer belt is adjusted to a value within the range of from $1\times10^{8}$ to $1\times10^{12}$ Ω/□.

In other words, controlling the volume resistance and the surface resistance of the intermediate transfer belt to be a value within a predetermined range by means of this image forming method enables a toner to be stably transferred onto the intermediate transfer belt, even if a photoconductor drum serving as the image support body and a primary transfer roller serving as the primary transfer means are configured so as to be offset placed.

Additionally, the photoconductor drum and the primary transfer roller are offset placed. With this configuration, when a toner is transferred onto the intermediate transfer belt, the central fade-out rarely occurs.

DETAILED DESCRIPTION OF THE PREFERRED EMBODIMENTS

First Embodiment

A first embodiment is an image forming device comprising an image support body on which an electrostatic latent image is formed, a developer which develops the electrostatic latent image formed on the image support body with a toner to form a toner image, an intermediate transfer belt onto which the toner image formed on the image support body is transferred, a primary transfer means for transferring the toner image on the image support body onto the intermediate transfer belt, and a secondary transfer means for transferring the toner image on the intermediate transfer belt onto paper, the image support body and the primary transfer means being offset placed, wherein a volume resistance of the intermediate transfer belt is adjusted to a value within the range of from $1\times10^{7}$ to $1\times10^{11}$ Ω·cm and a surface resistance of the intermediate transfer belt is adjusted to a value within the range of from $1\times10^{8}$ to $1\times10^{12}$ Ω/□.

The configuration of the image forming device, etc will be specifically set forth on the basis of a color image forming device hereinafter, and a toner used for image formation will be specifically described in an image forming method of a second embodiment.

1. Image Forming Device (1) Fundamental Configuration

Figure 1:
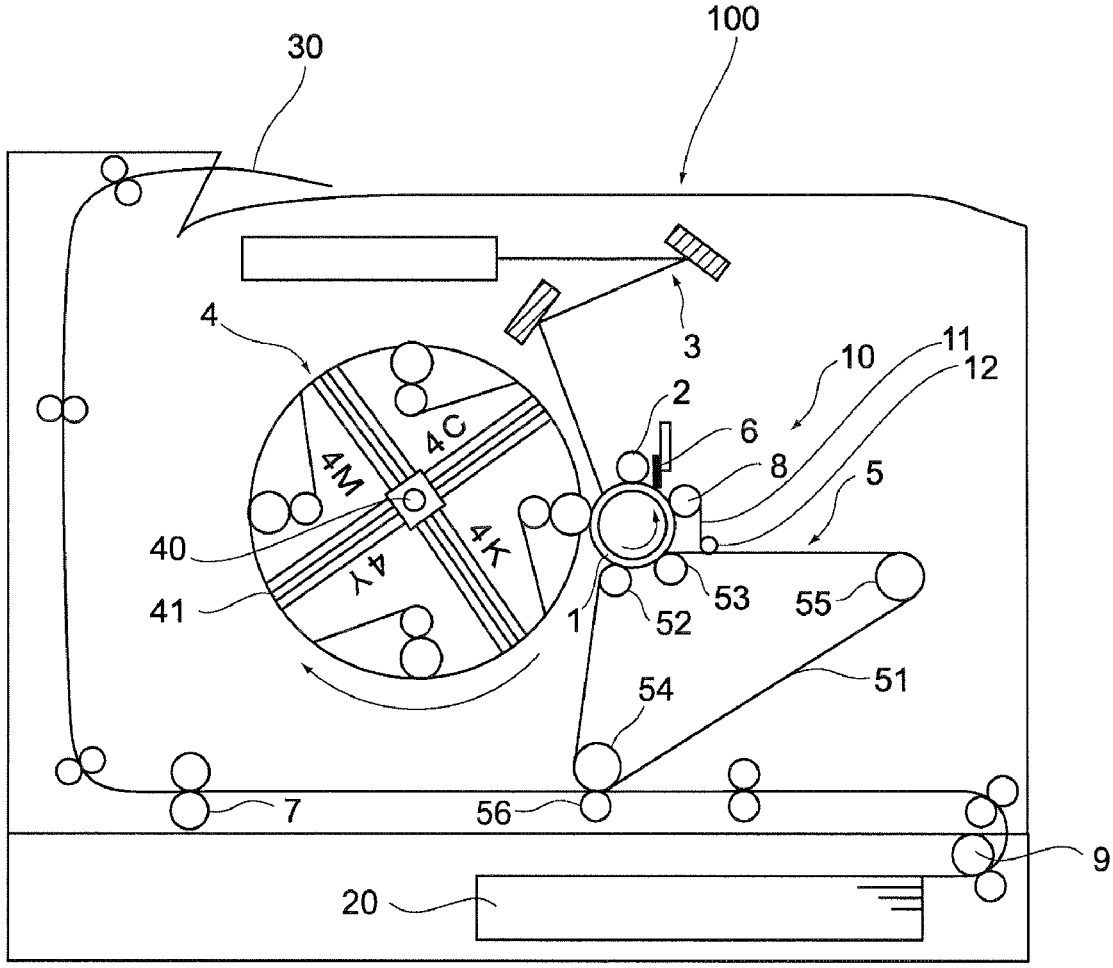
FIG. 1 is a diagram for depicting a fundamental structure of a color image forming device.

FIG. 1 is a schematic block diagram of an image forming device according to the present invention and indicates a color laser printer as one example. As illustrated in FIG. 1, an image forming section 10 includes a photoconductor drum 1 and also, in the periphery of the photoconductor drum 1 in order along its moving direction, includes a charging device 2, an exposure device 3, a developing device 4, a transfer device 5, a roller 8 and a cleaning blade 6.

In addition, downstream of a paper conveying direction of the photoconductor drum 1, a fixing means 7 is disposed. Moreover, in a lower portion of the image forming device 100, a paper feeding portion 20 is disposed; downstream of a paper feeding direction of the paper feeding portion 20, a paper feeding roller 9 is disposed.

(2) Photoconductor Drum

Additionally, an electrostatic latent image is formed on a surface of the photoconductor drum 1 shown in FIG. 1. The present embodiment uses an amorphous silicon photoconductor and its configuration has a carrier injection preventing layer comprising Si:H:B:O, etc, a carrier excitation transferring layer (photo-conductive layer) comprising Si:H, etc, and a surface protecting layer comprising SiC:H etc, laminated on its electroconductive substrate in order listed.

This is because the use of an amorphous silicon drum as the photoconductor drum can improve the durability of the photoconductor drum.

On the other hand, an amorphous silicon drum has a large friction resistance on its surface and a phenomenon in which the outermost surface layer of a toner image transferred on an intermediate transfer belt is affixed on a photoconductor drum and peeled, i.e., central fade-out is readily generated. However, the image forming device of the present invention can prevent the generation of such central fade-out of a letter.

(3) Charging Device

Moreover, the charging device 2 shown in FIG. 1 is disposed in the upper portion of the photoconductor drum 1 and is a device for uniformly charging the photoconductor drum 1.

As the charging device 2, charging means of a non-contact type such as a scorotron is preferably used, and a charging roller is more preferably used.

The reason is that such a charging roller can effectively suppress discharge products such as ozone, which are liable to be generated in a non-contact charging system.

(4) Exposure Device

Furthermore, the exposure device 3 shown in FIG. 1 is a device for forming an electrostatic latent image on the photoconductor drum 1 on the basis of a document image read from an image data input portion (not shown).

(5) Developing Device

In addition, the developing device 4 illustrated in FIG. 1 is a device of forming a toner image by feeding a toner onto the surface of the photoconductor drum 1 on which an electrostatic latent image is formed.

Such a developing device 4 preferably comprises a rotary rack 41 and a plurality of developers 4Y, 4M, 4C, 4K.

Here, the rotary rack 41, while rotating around a rotational axis 40 by rotation means (not shown), moves in order the plurality of developers 4Y, 4M, 4C, 4K to a developing position facing the photoconductor drum to carry out development.

Additionally, of the plurality of developers, a yellow developer 4Y, a magenta developer 4M, a cyan developer 4C and a black developer 4K are arranged in the peripheral direction of the rotary rack 41 in the order 4Y, 4M, 4C and 4K and held, and the adjacent developers are placed at intervals of about 90 degrees in the peripheral direction.

(6) Transfer Device

Moreover, the transfer device 5 shown in FIG. 1 is a device for transferring a toner image of the photoconductor drum 1 to paper and includes an intermediate transfer belt 51, a tension roller 52, a primary transfer roller 53, a driving roller 55, a secondary transfer facing roller 54, and a secondary transfer roller 56. Additionally, the primary transfer roller 53 is in a state in which the largest pressurization point of the primary transfer roller 53 to the intermediate transfer belt 51 is shifted from the largest pressurization point of the photoconductor drum 1 to the intermediate transfer belt 51, relative to the photoconductor drum 1, and thus in, what is called, a offset placement, and is configured so as to prevent the central fade-out of a toner image.

Furthermore, the extent of the offset placement is suitable so long as the largest pressurization point of the primary transfer roller 53 is shifted from a position onto which a color toner is transferred from the photoconductor drum 1 to the intermediate transfer belt 51. For example, the extent is preferably a value within the range of from 1 to 30 mm, more preferably a value within the range of from 2 to 20 mm, still more preferably a value within the range of from 3 to 18 mm.

In addition, the intermediate transfer belt 51 is wound on the tension roller 52, the primary transfer roller 53, the driving roller 55 and the secondary transfer facing roller 54 in an endless fashion, and driven by the driving roller 55. Onto the intermediate transfer belt 51 is transferred a toner image formed on the photoconductor drum 1 and the intermediate transfer belt 51 serves as a transfer material on which the toner image is temporarily held. Additionally, a preferred aspect for the intermediate transfer belt 51 will be set forth hereinafter.

Next, referring to FIGS. 2 and 3, the relationship between the above described offset placement and the central fade-out of a toner image will be described more specifically.

Figure 2A:
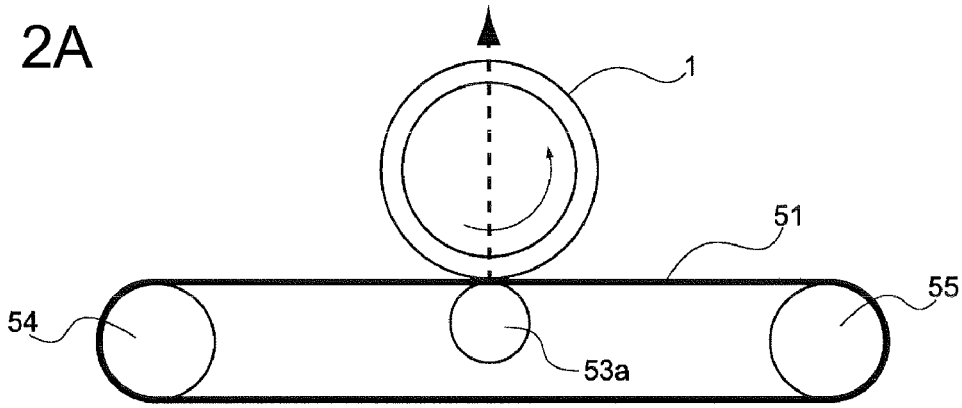
FIGS. 2A to 2C are diagrams for depicting non-offset and offset placements.

First, FIG. 2A illustrates a conventional non-offset placement state. When such offset placement is adopted, the largest pressurization point of a primary transfer roller 53*a* is in agreement with the largest pressurization point of the photoconductor drum 1, to the intermediate transfer belt 51.

Therefore, when a non-offset placement is adopted, an excessive pressure is likely to be generated between a toner image formed on the intermediate transfer belt 51 and the photoconductor drum 1.

This renders the friction between a toner image formed on the intermediate transfer belt 51 and the photoconductor drum 1 to become excessively large, thereby readily changing the charging amount of the toner forming the toner image.

As a result, a toner changed in the charging amount adheres to the photoconductor drum 1 from the intermediate transfer belt 51, whereby the so-called central fade-out of a toner image is liable to occur.

Next, a process of generating central fade-out of such a toner image will be described in reference to FIG. 3.

Figure 3A:
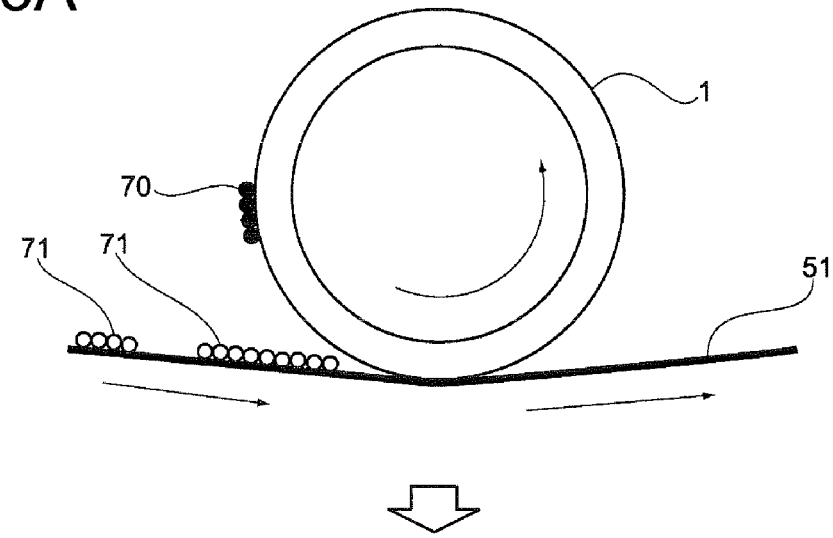
FIGS. 3A to 3C are diagrams for depicting a process of generating the central fade-out of a toner image.

First, FIG. 3A is a diagram showing a state of a toner 71 being already transferred on the intermediate transfer belt 51 and a state immediately before a toner 70 having a color different from the color of the toner 71 being further transferred onto a predetermined site of the toner image.

Figure 3B:
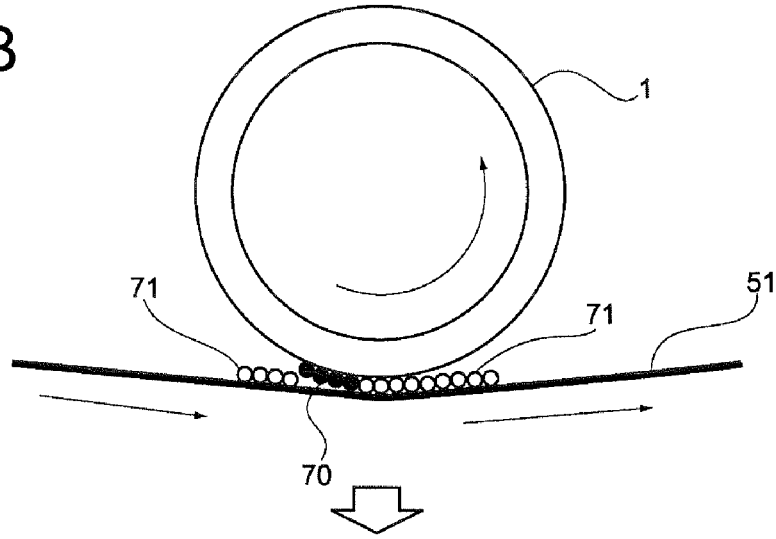

In addition, FIG. 3B illustrates a diagram showing the next stage of FIG. 3A.

In other words, the drawing shows a state in which a toner image composed of the toner 70 is transferred onto the predetermined site on the intermediate transfer belt 51.

At this time, it is understood that the toner image composed of the toner 71 already transferred on the intermediate transfer belt 51 is expected to make contact with the photoconductor drum 1.

Then, during such contact, when the friction between the toner image composed of the toner 71 and the photoconductor drum 1 becomes excessively large, a portion of the toner 71 is likely to be changed in the charging amount. As a result, the balance of the electrostatic adhesive force between the intermediate transfer belt 51 and the photoconductor drum 1 will be changed.

Figure 3C:
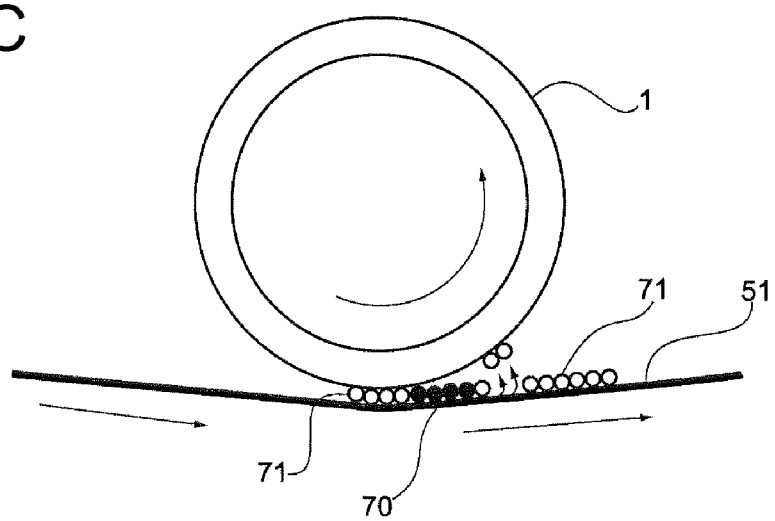

Next, FIG. 3C is a diagram showing the next stage of FIG. 3B.

That is to say, the drawing indicates a state in which the toner image composed of the toner 70 is completely transferred onto the predetermined site on the intermediate transfer belt 51.

At this time, in the stage of FIG. 3B, a portion of the toner 71 changed in the charging amount due to its excessive friction with the photoconductor drum 1 is changed in its balance of electrostatic adhesive force. As a result, the portion is readily affixed to the photoconductor drum 1. As shown in FIG. 3C, a phenomenon in which a toner is detached from the toner on the intermediate transfer belt 51 and thus central fade-out is prone to occur.

Figure 2B:
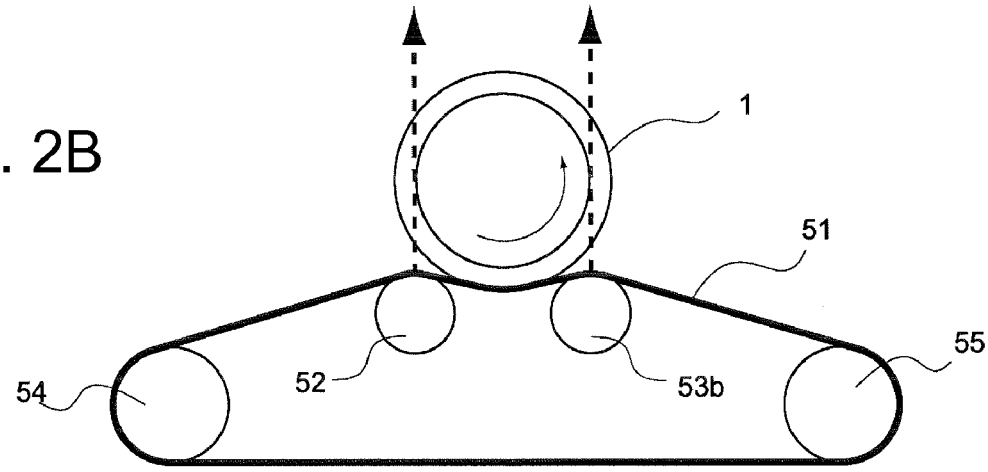
Figure 2C:
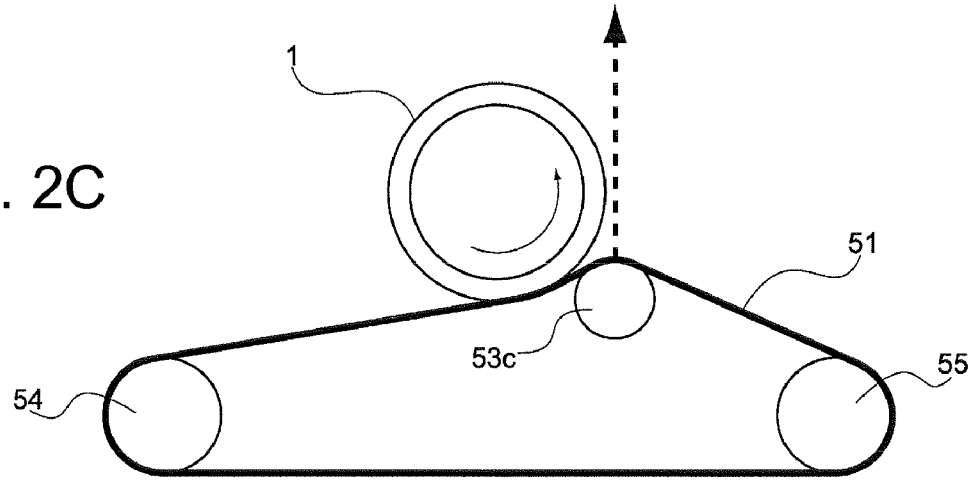

Therefore, for the prevention of the above described central fade-out of the toner image, in the present invention, not the conventional non-offset placement illustrated in FIG. 2A but an offset placement shown in FIG. 2B or 2C is adopted to suppress excessive friction between a toner image on the intermediate transfer belt 51 and the photoconductor drum 1.

Additionally, the offset placement shown in FIG. 2B indicates an offset placement in the case where the largest pressurization points of a primary transfer roller 53*b* and the tension roller 52 to the intermediate transfer belt 51 are each shifted from the largest pressurization point of the photoconductor drum 1.

On the other hand, the offset placement shown in FIG. 2C indicates an offset placement only constituted by a primary transfer roller 53*c* and the photoconductor drum 1, with the tension roller removed.

Moreover, when such offset placement is adopted, a predetermined amount of current is made to flow to the largest pressurization point of the photoconductor drum to the intermediate transfer belt, from the largest pressurization point of the primary transfer roller to the intermediate transfer belt, and a predetermined transfer bias needs to be formed between the photoconductor drum and the intermediate transfer belt, in the transfer site.

Thus, even when the offset placement is adopted, in order to prevent central fade-out in a toner image, the volume resistance and the surface resistance in the intermediate transfer belt are each made to be in predetermined ranges and the predetermined transfer bias needs to be formed.

The volume resistance and the surface resistance in the intermediate transfer belt will be specifically described in the paragraph of the intermediate transfer belt below.

On the other hand, the secondary transfer roller 56 is placed in a position opposite to the secondary transfer facing roller 54 on the outer periphery of the intermediate transfer belt 51 and serves to secondarily transfer a toner image to a transfer material.

(7) Cleaning Blade

Furthermore, the cleaning blade 6 shown in FIG. 1 is a device for cleaning stuck materials such as a residual developing agent left on the photoconductor drum 1, and the blade composed of rubber of a hardness of from 60 to 80 degrees (e.g., polyurethane and the like) is preferably pressure contacted with the photoconductor drum at a line pressure of from 10 to 40 N/m.

(8) Roller

In addition, the roller 8 contacts with the surface of the photoconductor drum 1 and serves as a buffer that recovers or discharges a toner. Here, the roller 8 is configured so as to coat the periphery of a metal shaft with a rubber layer having a hardness of from 40 to 70 degrees (e.g., a foam rubber layer, and the like) and is preferably urged to the photoconductor drum 1 with springs (not shown) at both ends of a bearing at 500 to 2000 gf (one spring: 250 to 1000 gf).

Moreover, the rotation direction of the roller 8 is in a counter direction relative to that of the photoconductor drum. It is preferably configured so as to stop driving transmit to the roller 8 by means of a clutch (not shown) when cleaning operation is not performed.

Therefore, although the roller 8 is preferably rotated in the counter direction for having toners coming to the cleaning section in sequence remain in the proximity of a blade edge, the roller 8 may be rotated in a with direction when adhesion and discharge are controlled by bias polarity applied to the roller 8.

Furthermore, although the driving transmit clutch is disposed so that the photoconductor drum is not abraded needlessly, the driving does not need to be stopped to make the operation in an off state, when lamination thickness of the drum is sufficient.

In addition, with a rotational speed of the roller 8, a surface speed at a contact portion is larger than that of the drum and preferably set to 1 to 1.5 times larger than that of the drum. Additionally, the fixing means 7 is a device for fixing a transferred toner image onto paper.

Additionally, it is preferred that a scraper 11 for peeling a toner stuck to the roller is disposed and also a recovering screw 12 for recovering a toner stuck to the roller or a toner scraped off by the blade and fallen on the roller. Such a recovering screw 12 can discharge a recovered residual toner into a disposal toner box (not shown).

2. Intermediate Transfer Belt (1) Volume Resistance (R1)

The volume resistance (R1) of the intermediate transfer belt is made to be characteristically a value within the range of from $1\times10^{7}$ to $1\times10^{11}$ Ω·cm.

This is because controlling the volume resistance (R1) of the intermediate transfer belt to be a value within a predetermined range in this manner makes it possible to stably transfer a toner onto the intermediate transfer belt between the photoconductor drum and the primary transfer roller, together with the effect of controlling the surface resistance (R2) of the intermediate transfer belt to be in a predetermined range, even though the photoconductor drum and the primary transfer roller are configured so as to be offset placed.

In other words, the reason is that when the volume resistance of the intermediate transfer belt becomes less than $1\times10^{7}$ Ω·cm, the electrostatic adhesion force between the intermediate transfer belt and a toner is excessively lowered, thereby making it difficult to stably transfer a toner. On the other hand, when the volume resistance of the intermediate transfer belt exceeds $1\times10^{11}$ Ω·cm, the advantage of an application voltage during transfer hardly appear due to the offset placement, so that it is difficult to stably transfer a toner onto the intermediate transfer belt from the photoconductor drum.

Moreover, controlling the volume resistance of the intermediate transfer belt to be a value within a predetermined range in this manner enables the photoconductor drum and the transfer roller to be offset placed. Thus, the occurrence of the central fade-out can be restrained when a toner is transferred onto the intermediate transfer belt.

Therefore, the volume resistance of the intermediate transfer belt is preferably adjusted to a value within the range of from $1\times10^{7}$ to $1\times10^{10}$ Ω·cm, more preferably a value within the range of from $1\times10^{7}$ to $2\times10^{9}$ Ω·cm.

Furthermore, the volume resistance of the intermediate transfer belt can be adjusted as appropriate by controlling a primary component of a resin to be used and the addition quantity of an electroconductive material to be added thereto as well as the dispersion condition.

In addition, the volume resistance of the intermediate transfer belt can be measured using an electrode in accordance with JIS K 6911.

More specifically, the volume resistance can be measured at an application voltage of 250 V in accordance with JIS K 6911 using a resistance meter (trade name: Hiresta-IP, available from Mitsubishi Chemical Corp.) and an electrode (trade name: HR-100, available from Mitsubishi Chemical Corp.).

(2) Surface Resistance (R2)

The surface resistance (R2) of the intermediate transfer belt is made to be characteristically a value within the range of from $1\times10^{8}$ to $1\times10^{12}$ Ω/□.

The reason is that controlling the surface resistance (R2) of the intermediate transfer belt to be a value within a predetermined range in this manner makes it possible to stably transfer a toner onto the intermediate transfer belt between the photoconductor drum and the transfer roller, together with the effect of controlling the volume resistance (R1) of the intermediate transfer belt to be in a predetermined range, even though the photoconductor drum and the transfer roller are configured so as to be offset placed.

In other words, the reason is that when the surface resistance of the intermediate transfer belt becomes less than $1\times10^{8}$ Ω/□, a current excessively flows to the intermediate transfer belt surface, whereby discharging prior to transfer is likely to occur upstream of a primary transfer region in some cases. On the other hand, when the surface resistance of the intermediate transfer belt becomes a value exceeding $1\times10^{12}$ Ω/□, the amount of a current at the intermediate transfer belt surface is excessively lowered, so that it is difficult to secure a sufficient transfer current in some cases.

Moreover, controlling the surface resistance of the intermediate transfer belt to be a value within a predetermined range in this manner enables the photoconductor drum and the transfer roller to be offset placed. Thus, the occurrence of the central fade-out can be effectively restrained when a toner is transferred onto the intermediate transfer belt.

Therefore, the surface resistance of the intermediate transfer belt is preferably adjusted to a value within the range of from $1\times10^{9}$ to $1\times10^{11}$ Ω/□.

Furthermore, the surface resistance of the intermediate transfer belt can be adjusted as appropriate by controlling a primary component of a resin to be used and the addition quantity of an electroconductive material to be added thereto as well as the dispersion condition and also further smoothing the surface conditions.

In addition, the surface resistance of the intermediate transfer belt can be measured using an electrode in accordance with JIS K 6911.

More specifically, the surface resistance can be measured by the means of measurement conditions as in the case of the above described volume resistance.

Next, referring to FIGS. 4 and 5, the relation between the volume resistance and the surface resistance of the intermediate transfer belt and a current flowing in the intermediate transfer belt or via its surface and the transfer bias will be described more specifically.

Figure 4:
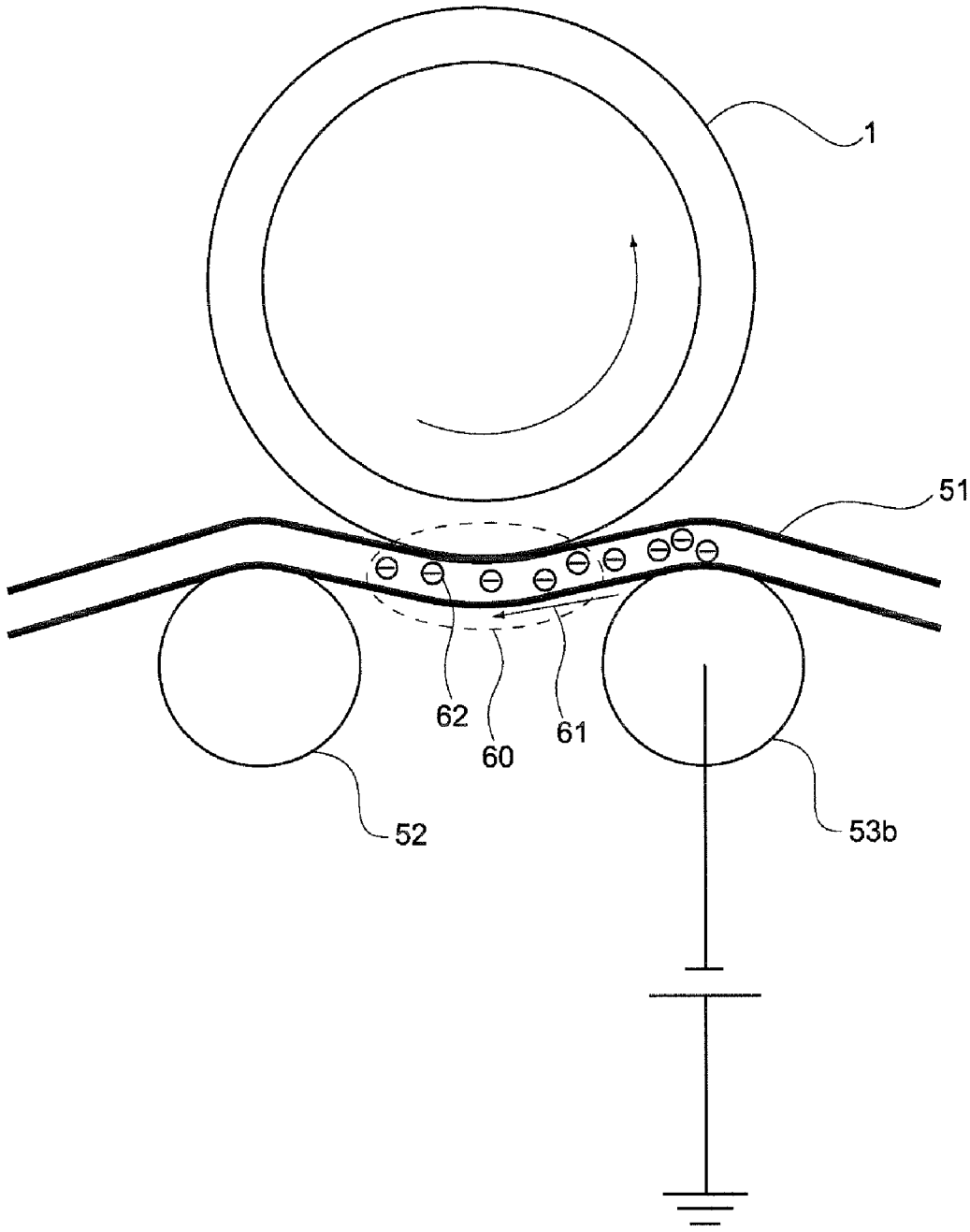
FIG. 4 is a diagram for depicting a distribution of charges, etc in an intermediate transfer belt.

In other words, even when the offset placement is adopted, as shown in FIG. 4, an amount of charge 62 in a transfer site 60 of the intermediate transfer belt 51 and its distribution need to be made in a predetermined range in order to prevent the central fade-out in a toner image and carry out effective transfer.

This is because the predetermined transfer bias is formed between the photoconductor drum 1 and the intermediate transfer belt 51 in the transfer site 60 and a toner image formed on the photoconductor drum 1 is effectively electrostatically moved and affixed onto the intermediate transfer belt 51.

In this respect, in the present invention, as described above, by setting each of the volume resistance and the surface resistance of the intermediate transfer belt 51 to be a value within the predetermined range, the charge 62 in the transfer site 60 and its distribution can be made to be in predetermined ranges.

Figure 5A:
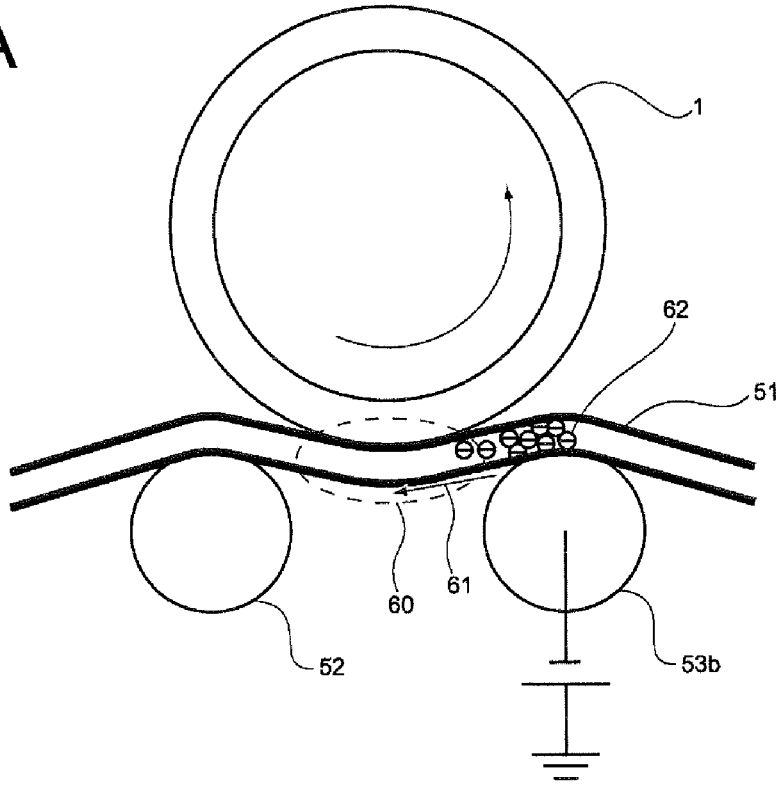
FIGS. 5A and 5B are other diagrams for depicting a distribution of charges, etc in an intermediate transfer belt.

More specifically, when the volume resistance or the surface resistance of the intermediate transfer belt 51 becomes a value exceeding a predetermined range, as shown in FIG. 5A, a predetermined current 61 is made difficult to flow from the primary transfer roller 53*b* to the transfer site, thereby being incapable of distributing the charge 62 in a sufficient amount in the transfer site 60, so that the formation of a predetermined transfer bias becomes difficult in some cases.

Figure 5B:
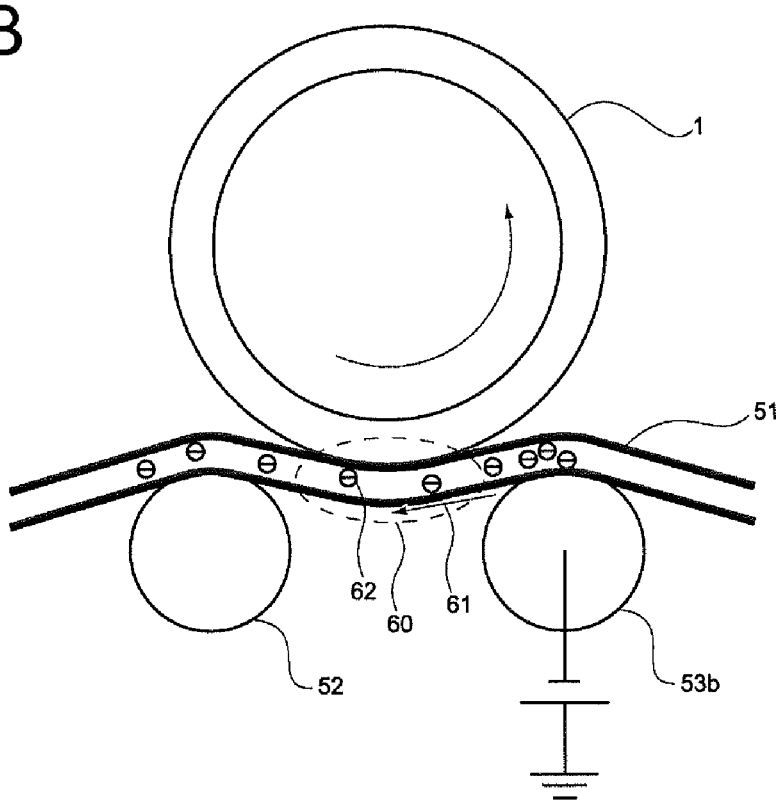

On the other hand, when the volume resistance or the surface resistance of the intermediate transfer belt 51 becomes a value of less than a predetermined value, as illustrated in FIG. 5B, a predetermined amount of the charge 62 cannot be distributed in the transfer site 60, which makes it difficult to form a predetermined transfer bias in some cases.

Accordingly, when the offset placement is adopted, it is understood that the volume resistance and the surface resistance of the intermediate transfer belt each need to be values within predetermined ranges in order to flow a predetermined current to the intermediate transfer belt and to form a predetermined transfer bias in the transfer site.

(3) Volume Resistance (R1)/Surface Resistance (R2)

Additionally, the numerical value expressed by R1/R2 is preferably adjusted to a value within the range of from 0.01 to 100 (Ω·cm/(Ω/□)).

The reason is that controlling the ratio of the volume resistance (R1 (Ω·cm)) to the surface resistance (R2 (Ω/□)), of the intermediate transfer belt, enables a toner to be further stably transferred to the intermediate transfer belt between the photoconductor drum and the transfer roller.

In other words, although the volume resistance (R1) and the surface resistance (R2), of the intermediate transfer belt, mutually affect the transferability of a toner, considering these relations makes it possible to secure the stability of the transferability of a toner even in a case wherein surrounding environments condition, etc, is changed.

Accordingly, the numerical value expressed by R1/R2 is made to be more preferably a value within the range of from 0.015 to 0.5 (Ω·cm/(Ω/□)), still more preferably a value within the range of from 0.02 to 0.1 (Ω·cm/(Ω/□)).

(4) Current Value

Moreover, upon the configuration of the image forming device, it is preferred to be configured that during the transfer of a toner, the amount of flow-in current flowing to the photoconductor drum from the transfer roller is preferably adjusted to a value within the range of from 0.1 to 50 μA.

The reason is that controlling a current value flowing from the transfer roller to the photoconductor drum in this manner enables a toner to be further stably transferred to the intermediate transfer belt.

Furthermore, this is because monitoring the current value enables the transferability of a toner to the intermediate transfer belt to be quantitatively controlled.

Accordingly, the current value flowing between the photoconductor drum and the transfer roller is made to be more preferably a value within the range of from 0.5 to 30 μA, still more preferably a value within the range of from 1 to 20 μA.

In addition, the flow-in current value of the photoconductor drum can be measured by detecting a current flowing in the photoconductor drum when the primary transfer roller is made to be in an on state.

(5) Modulus of Elasticity

Additionally, the modulus of elasticity of the intermediate transfer belt is preferably adjusted to a value within the range of from $1\times10^1$ to $1\times10^3$ MPa.

The reason is that controlling the modulus of elasticity of the intermediate transfer belt in this way to be in a predetermined range enables the durability of the intermediate transfer belt, transferability of a toner and further the fixing property of a toner to be stably controlled.

In other words, this is because the transferability and fixing property of a toner are sometimes lowered due to the instability of a rotational speed.

Accordingly, the elastic modulus of the intermediate transfer belt is preferably adjusted to a value within the range of from $5\times10^1$ to $1\times10^3$ MPa, more preferably a value within the range of from $5\times10^1$ to $5\times10^2$ MPa.

Moreover, the modulus of elasticity of the intermediate transfer belt can be measured in accordance with JIS K 7127.

More specifically, the measurement can be performed based on the measurement conditions below.

Measuring Apparatus Autograph (available from Shimadzu Corporation)

Measuring Speed: 50 mm/min.

Measuring Sample: 250 mm×25 mm

Measuring Conditions: Aged for 24 hours in conditions of 25° C. and 45% RH and then measured.

(6) Surface Roughness (Rz)

Furthermore, the surface roughness (Rz) of the intermediate transfer belt is preferably adjusted to a value within of less than 1.5 μm.

The reason is that controlling the surface roughness (Rz) of the intermediate transfer belt in this manner to be in a predetermined range enables the durability of the intermediate transfer belt, the transferability of a toner and further the fixing property of a toner to be quantitatively controlled.

In addition, monitoring the surface roughness (Rz) of the intermediate transfer belt makes it possible to determine the abrasion state of the intermediate transfer belt to thereby set a standard for determination of its change time.

However, when the surface roughness (Rz) of the intermediate transfer belt becomes excessively small, stable production becomes difficult, or the kinds or the amounts of resins or electroconductive agents to be used, etc are excessively restrained in some cases.

Accordingly, the surface roughness (Rz) of the intermediate transfer belt is preferably adjusted to a value within the range of from 0.01 to 1.2 μm, more preferably a value within the range of from 0.1 to 1.0 μm.

Additionally, the surface roughness (Rz) of the intermediate transfer belt can be measured in accordance with JIS B 0601.

More specifically, the measurement can be carried out using the measuring conditions below.

Measuring Apparatus Surfcom 1500DX (available from Tokyo Seimitsu Co., Ltd.)

Measuring Pressure: 0.7 mN

Measuring Length: 2.4 mm

Parameter Calculation Standards: JIS 1994

(7) Thickness

Moreover, the thickness of the intermediate transfer belt is preferably adjusted to a value within the range of from 50 to 200 μm.

The reason is that controlling the thickness of the intermediate transfer belt to being predetermined range enables the durability of the intermediate transfer belt, the transferability of a toner and further the fixing property of a toner to be stably controlled.

In other words, when the thickness of the intermediate transfer belt becomes less than 50 μm, the durability is extremely lowered, or the transferability and the fixing property of a toner are decreased due to the instability of the rotational speed in some cases. On the other hand, when the thickness of the intermediate transfer belt exceeds 200 μm, the weight becomes large or the rotational speed becomes unstable, and thus, the transferability and the fixing property of a toner are lowered in some cases.

Accordingly, the thickness of the intermediate transfer belt is preferably adjusted to a value within the range of from 60 to 180 μm, more preferably a value within the range of from 80 to 150 μm.

Furthermore, the thickness of the intermediate transfer belt can be measured by means of a micrometer.

(8) Resin Composition

In addition, it is preferred that the intermediate transfer belt is formed from a resin composition comprising a polyamide resin, a thermoplastic elastomer and an electroconductive material and also the addition quantity of the thermoplastic elastomer is adjusted to a value within the range of from 10 to 150 parts by weight based on 100 parts by weight of the polyamide resin and the addition quantity of the electroconductive material is adjusted to a value within the range of from 0.1 to 100 parts by weight based on the amount of resin composition.

The reason is that controlling the configuration material of the intermediate transfer belt to be in a predetermined range makes good the durability of the intermediate transfer belt and also adjustable the charging property, electroconductivity, etc. As a result, the transferability of a toner and further the fixing property of a toner can be stably controlled.

In other words, this is because when the addition quantity of a thermoplastic elastomer becomes a value of less than 10 parts by weight, utility is lowered or the adjustment of charging property, electroconductivity or the like becomes difficult in some cases. On the other hand, this is because when the addition quantity of a thermoplastic elastomer exceeds 150 parts by weight, not only the durability of the intermediate transfer belt is lowered, but the adjustment of charging property, electroconductivity or the like becomes difficult in some cases.

Accordingly, the addition quantity of the thermoplastic elastomer is made to be more preferably a value within the range of from 15 to 60 parts by weight based on 100 parts by weight of the polyamide resin.

On the other hand, when the addition quantity of an electroconductive material becomes a value of less than 0.1 parts by weight, the utility is lowered or the adjustment of charging property, electroconductivity or the like becomes difficult in some cases. Inversely, when the addition quantity of an electroconductive material exceeds 100 parts by weight, not only the durability of the intermediate transfer belt is lowered, but the adjustment of charging property, electroconductivity or the like becomes difficult in some cases.

Accordingly, the addition quantity of the electroconductive material is preferably adjusted to a value within the range of from 5 to 90 parts by weight, more preferably a value within the range of from 20 to 60 parts by weight, based on 100 parts by weight of the polyamide resin.

Moreover, suitable electroconductive materials include single kinds of materials such as carbon block, carbon particles, metal particles, electroconductive ceramic particles and electroconductive organic particles or combinations of two or more kinds of materials thereof.

Here, carbon blacks that are preferred include, specifically, acetylene black, furnace black, and channel black. Of these, acetylene black is preferably used in order to effectively prevent a bad appearance due to carbon aggregation.

Furthermore, the carbon particles include graphite, carbon fiber, activated carbon, and charcoal.

In addition, the metal particles include powder particles of silver, copper, nickel, zinc, etc, aluminum flakes, silver flakes, nickel flakes, and fibrous particles of iron, copper, stainless steel, etc.

The electroconductive ceramic particles include a zinc oxide, a tin oxide, an indium oxide, and a titanium oxide.

Additionally, the electroconductive organic particles include particles produced by laminating metal materials such as gold, silver, nickel, etc, around polymer particles.

Moreover, the polyamide resins include aliphatic polyamides such as single condensation polymers of nylon 6, nylon 11 and nylon 12, and co-condensation polymers such as nylon 6/6, nylon 6/10 and nylon 6/12.

In other words, this is because an aliphatic polyamide is hardly relatively negative-charged, and thus in particular can improve the transferability of a positively charged toner as well as cleaning property.

Furthermore, the thermoplastic elastomers that can be used include elastomers such as polyester-based, polyamide-based, polyether-based, polyolefin-based, polyurethane-based styrene-based, acrylic, and polydiene-based elastomers, and in particular, polyamide-based thermoplastic elastomers are preferred.

The reason is that the use of a polyamide-based thermoplastic elastomer in this manner not only improves its compatibility with a polyamide resin and the durability of the intermediate transfer belt, but makes further adjustable the charging property, electroconductivity, etc.

In other words, a polyamide-based thermoplastic elastomer has characteristics of good adhesion properties not only to polyamide resins, but to non-olefin-based resins such as ABS resins, polycarbonate resins, and the like. Because of this, the control of adhesion properties to a toner is easy. Additionally, a polyamide-based thermoplastic elastomer is also excellent in oil resistance and also has the advantage of being hardly swollen, as compared with styrene-based and olefin-based thermoplastic elastomers.

Moreover, polyamide-based thermoplastic elastomers (products) include Pebacks (available from Atofina Japan Co., Ltd.), UBE Polyamide Elastomer (available from Ube Industries, Ltd.), Grilon ELX and Grilamid ELY (both available from EMS Showa Denko KK), and Diamid and Bestamid (both available from Dicel Degussa Ltd.).

Furthermore, the resin composition preferably contains a compatiblizer between a polyamide resin and a thermoplastic elastomer.

The reason is that the use of a compatiblizer in this manner improves compatibility between a polyamide resin and a thermoplastic elastomer, and not only improves the durability of the intermediate transfer belt, but makes further adjustable the charging property, electroconductivity, etc.

In addition, the kind of compatiblizers is not particularly limited, and examples include olefin low molecular substances, plasticizers, oils, coupling agents, and macromonomers. Additionally, when a compatiblizer is added, the addition quantity is preferably adjusted to a value within the range of from 0.1 to 10 parts by weight based on 100 parts by weight of the polyamide resin.

Second Embodiment

A second embodiment is an image forming method by an image forming device comprising an image support body on which an electrostatic latent image is formed, a developer of developing the electrostatic latent image formed on the image support body with a toner to form a toner image, an intermediate transfer belt onto which the toner image formed on the image support body is transferred, a primary transfer means for transferring the toner image on the image support body onto the intermediate transfer belt, and a secondary transfer means for transferring the toner image on the intermediate transfer belt onto paper and in which the photoconductor drum and the primary transfer means are offset placed, wherein the volume resistance of the intermediate transfer belt is adjusted to a value within the range of from $1\times10^{7}$ to $1\times10^{11}$ Ω·cm and the surface resistance of the intermediate transfer belt is adjusted to a value within the range of from $1\times10^{8}$ to $1\times10^{12}$Ω/□.

The image forming method of the present invention will be specifically set forth in reference with drawings as appropriate hereinafter.

1. Toner

A positively charged toner used in the present invention can make use of a magnetic or nonmagnetic one-component toner, or a two-component toner produced by mixing a magnetic carrier with a nonmagnetic toner.

In addition, the average particle diameter of magnetic toners is not particularly limited and, for example, is preferably adjusted to a value within the range of from 5 to 12 μm.

The reason is that when the average particle diameter of such magnetic toners becomes less than 5 μm, the charging property and the flowability of the magnetic toner are lowered and further the degree of liberation of added particles is increased in some cases, while when the average particle diameter of such magnetic toner exceeds 12 μm, the flowability of a positively charged toner is decreased in some cases.

Accordingly, the average particle diameter of magnetic toners is made to be more preferably a value within the range of from 6 to 11 μm, still more preferably a value within the range of from 7 to 10 μm.

Additionally, the toner is preferably a positively charged toner.

The reason is that making the toner a positively charged toner can further effectively suppress the generation of central fade-out.

In other words, in order to obtain the intermediate transfer belt having predetermined volume and surface resistances, the use of a polyamide resin and a polyamide-based thermoplastic elastomer as resin compositions is effective.

On the other hand, since these resin compositions are hardly comparatively negatively charged, the use of a positively charged toner can readily be adjusted and also improve its transferability.

(1) Binding Resin

A binding resin used for a toner is not particularly limited, and examples that are preferably used include thermoplastic resins such as styrene resins, acrylic resins, styrene-acrylic copolymers, polyethylene resins, polypropylene resins, vinyl chloride resins, polyester resins, polyamide resins, polyurethane resins, polyvinyl alcohol resins, vinyl ether resins, N-vinyl resins and styrene-butadiene resins.

(2) Wax

Moreover, a toner requires the effects of fixing and offset properties, and thus a wax is preferably added thereto.

The kind of waxes is not particularly limited and examples include one kind of single waxes such as polyethylene waxes, polypropylene waxes, fluororesin waxes, Fisher Tropsch waxes, paraffin waxes, ester waxes, montan waxes and rice waxes, and combinations of two or more kinds of waxes thereof.

(3) Charge Control Agent

Moreover, a toner preferably has a charge control agent added thereto from the viewpoints of extremely improving charge level and charge build-up characteristics (an index of charging to a certain charge level in a short time) and thus obtaining characteristics excellent in durability and stability, etc.

The kind of charge control agents is not particularly limited, and for example, a charge control agent is preferably used that indicates a positive charging property such as nigrosin, a quaternary ammonium salt chemical compound and a resin type charge control agent produced by binding an amine-based compound to a resin.

(4) Magnetic Powder and Carrier

Furthermore, a well-known substance can be used as a magnetic powder or a carrier added to a toner.

The examples can include metals exhibiting ferromagnetism such as ferrite, magnetite, iron, cobalt and nickel or alloys thereof, or compounds containing these ferromagnetic elements, or alloys not containing a ferromagnetic element but exhibiting ferromagnetism produced by appropriate heat treatment, and the like.

(5) Additive (5)-1 Titanium Oxide

In addition, a toner preferably uses a titanium oxide as an additive.

The reason is that the use of the titanium oxide as an additive can further effectively polish a photoconductor drum using a rotational member. Accordingly, even when images are repeatedly formed, the surface of the photoconductor drum can be maintained in good conditions.

Additionally, the average particle diameter of the titanium oxide is preferably adjusted to a value within the range of from 0.01 to 0.50 μm.

The reason is that when the average particle diameter of the titanium oxide becomes less than 0.01 μm, uniform polishing is difficult to perform, whereby charge-up is caused or an image deletion occurs at a high temperature and a high humidity, leading to image failure in some cases.

On the other hand, this is because when the average particle diameter of the titanium oxide exceeds 0.50 μm, the deviation of the charging amount in a toner becomes large, sometimes lowering the image concentration and the durability.

Accordingly, the average particle diameter of titanium oxide is made to be more preferably a value within the range of from 0.02 to 0.4 μm, still more preferably a value within the range of from 0.05 to 0.3 μm.

Moreover, the average particle diameter of titanium oxide can be determined by a combination of an electronic microscope and an image analyzer. In other words, the lengths and the breadths of 50 particles are each measured under an electronic microscope, JSM-880, (available from JOEL DATUM Ltd.) at a magnification, as appropriate, of from 30,000 to 100,000, and then their average can be determined by an image analyzer and calculated.

(5)-2 Silica Particles

Furthermore, as an additive to a toner, silica particles (hereinafter, sometimes referred to as aggregated silica particles) are preferably exteriorly added.

In addition, in the silica particles, a particle distribution is preferred in which the proportion of the particles of the particle diameters of 5 μm or less is a value of 15 weight % or less and the proportion of the particles of the particle diameters of 50 μm or more is a value of 3 weight % or less.

The reason is that when the proportion of the silica particles of the particle diameter of 5 μm or less exceeds 15 weight %, the silica particles are liable to adhere to photoconductor particles and re-aggregate and also gather around silica particles having relatively large particle diameters and thus cause layer irregularities. On the other hand, this is because when the proportion of the silica particles of a particle diameter of 50 μm or more exceeds 3 weight %, silica particles having relatively small particle diameters are liable to gather around each other to form large aggregated silica particles and also cause layer irregularities.

Accordingly, a more preferred particle distribution of the silica particles has a proportion of a particle diameter of 5 μm or less being a value of 10 weight % or less and a proportion of a particle diameter of 50 μm or more being a value of 2 weight % or less, based on the total amount.

Moreover, a particle distribution of the silica particles can be measured by means of a laser diffraction particle meter, LA-500, available from HORIBA, LTD.

Furthermore, the addition quantity of silica is preferably adjusted to a value within the range of from 0.5 to 15.0 parts by weight based on 100 parts by weight of the toner.

The reason is that when the addition quantity of the additive is less than 0.5 parts by weight, the effect of improving the flowability of the toner is difficult to sufficiently observe. On the other hand, this is because when the addition quantity of the additive exceeds 15.0 parts by weight, the silica content in the toner within a cleaning device becomes extremely large.

Accordingly, the addition quantity of an additive is made to be more preferably a value within the range of from 0.7 to 10.0 parts by weight, still more preferably a value within the range of from 0.9 to 5.0 parts by weight, based on 100 parts by weight of the toner.

2. Image Forming Method

Next, a fundamental method of forming a color image using a color image forming device will be specifically described with reference to FIG. 1.

First, during image formation, the photoconductor drum 1 is charged by means of the charging device 2 and then the rotary rack 41 rotates around the rotational axis 40 disposed in its central portion. Then, the rotary rack 41 stops at a developing position, wherein the developer 4K corresponding to black of being a first color, located opposite to the photoconductor drum 1.

In this state, exposure corresponding to black is carried out by means of an exposure means 3, an electrostatic latent image corresponding to black is formed on the surface of the photoconductor drum 1. This electrostatic latent image becomes a toner image by the developer 4K and this toner image formed on the surface of the photoconductor drum 1 is transferred onto the transfer belt 51 by a transfer bias applied to the primary transfer roller 53.

The formation of the toner image of black onto the transfer belt 51 is completed, and then the rotary rack 41 rotates around the rotational axis 40 disposed in its center, and for example the developer 4C corresponding to cyan is positioned at a developing position.

Thereafter, the operation is similarly carried out on other colors cyan, magenta and yellow to thereby form a toner image of full color on the transfer belt 51.

As described above, in a process of primarily transferring a toner image onto the intermediate transfer belt 51, the secondary transfer roller 56 is separated from the transfer belt 51.

On the other hand, after a toner image of full color is formed on the transfer belt 51, the secondary transfer roller 56 is made contact with the transfer belt 51.

At the time, right on cue, to a transfer material delivered to a transfer position from the paper feeding portion 20 by means of the paper feeding roller 9 or the like is transferred a full color toner image formed on the transfer belt 51 by a secondary transfer bias applied to the secondary transfer roller Further, the full color toner image transferred on the transfer material is fixed on the transfer material by heating and pressurization by means of the fixing means 7 and then the transfer material is discharged to a paper ejection portion 30.

In addition, a residual developing agent left on the photoconductor drum 1 is cleaned by the cleaning blade 6 and is disposed of into a waste toner container (not shown). Additionally, a toner left on the transfer belt 51 is cleaned by contacting a cleaning device (not shown) of the transfer belt 51 with the transfer belt 51 after secondary transfer, and disposed of into the waste toner container (not shown). The cleaning device (not shown) of the transfer belt 51 cleans one round of the transfer belt 51 and then is separated from the transfer belt 51.

Moreover, during black and white image formation, the rotary rack 41 does not rotate and only the developer 4K is made to face the photoconductor drum 1 to perform development. Other operations of image formation are the same as during color image formation.

EXAMPLES

The present invention will be set forth in more detail by way of example hereinafter. In addition, needless to say, the descriptions below simply illustrate the present invention, and particularly without reasons the scope of the present invention is not limited to the descriptions below.

Example 1

1. Formation of Color Image

A color image was formed using a color image forming device shown in FIG. 1 under conditions of charging, drum operation, transfer and cleaning blade operation below.

Moreover, an intermediate transfer belt of the color image forming device was fabricated using an extruder. In other words, 100 parts by weight of Nylon 12 (available from Ube Industries, Ltd., UBESTA 3035JU3) of being a thermoplastic polyamide and 25 parts by weight of acetylene black were kneaded by a biaxial kneader to obtain pellets. The resulting pellets were extruded using an extruder to obtain the intermediate transfer belt having a width of 240 mm, a thickness of 140 μm. a volume resistance of $1.2\times10^{9}$ Ω·cm, and a surface resistance of $3.4\times10^{10}$Ω/□.

(1) Charging Conditions
AC bias: 1.2 kVpp
DC bias: 350 V (2) Drum Conditions
Environment: 23° C./50% RH
Original: Original having 6%-density for each color
Photoconductor: Amorphous silicon photoconductor (film thickness 15 μm)
Drum circumferential speed: 150 mm/s
Printing speed: 32 Sheets/min
Surface voltage: 270 V (3) Transfer Conditions
Primary transfer current: 16 μA
Secondary transfer current: 30 μA (4) Cleaning Blade Conditions
Blade hardness: 70° (JIS-A standard)
Material: Urethane
Thickness: 2.2 mm
Projection length: 11 mm
Line pressure: 22 g/cm
Contact pressure angle: 250

2. Evaluation (1) Evaluation of Density Difference

Ten thousand (10,000) sheets of a color image were continuously formed and then the difference between the largest and smallest transmission densities of the resulting output images was measured by a transmission density measuring device, X-Rite 310TR, available from X-Rite, Inc. and transferability was evaluated on the basis of the following criteria. The results obtained are shown in Table 1.

Very good: The difference of transmission densities is a value of less than 0.15.

Good: The difference of transmission densities is a value of from 0.15 to 0.25 (exclusive).

Fair: The difference of transmission densities is a value of from 0.25 to 0.35 (exclusive).

Bad: The difference of transmission densities is a value of 0.35 or more.

(2) Evaluation of Central Fade-Out Generation

In addition, ten thousand (10,000) sheets of a color image were continuously formed and then central fade-out evaluating image charts were printed. The presence or absence of central fade-out generation was ascertained and the rate of occurrence of the central fade-out was evaluated on the basis of the criteria below. The rate of occurrence of central fade-out is obtained from the proportion (%) of the number of central faded-out dots when a total of 1000 dots (width 20 dots×length 50 dots) of fine dots (1 mm×1 mm) are printed. The results obtained are shown in Table 1.

Very Good The proportion of the number of central faded-out dots generated is a value of less than 7%.

Good: The proportion of the number of central faded-out dots generated is a value of from 7 to 10% exclusive.

Fair: The proportion of the number of central faded-out dots generated is a value of from 10 to 15% exclusive.

Bad: The proportion of the number of central faded-out dots generated is a value of 15% or more.

Example 2

In Example 2, an intermediate transfer belt was produced in the same manner as in Example 1 except that 100 parts by weight of Nylon12 (available from Ube Industries, Ltd., UBESTA 3035JU3) of being a thermoplastic polyamide, 20 parts by weight of a thermoplastic elastomer, PA12 Elastomer, (available from Dicel Degussa Ltd., Diamid, Bestamid E68) and 30 parts by weight of acetylene black were kneaded by means of a biaxial kneader to obtain pellets, and evaluated as in Example 1.

Additionally, the volume resistance was $1.5\times10^{9}$ Ω·cm and the surface resistance, of the intermediate transfer belt, was $5.2\times10^{10}$ Ω/□.

Example 3

In Example 3, an intermediate transfer belt having a volume resistance of $1.2\times10^{9}$ Ω·cm and a surface resistance of $1.1\times10^{10}$ Ω/□was produced in the same manner as in Example 1 except that polyvinylidene fluoride) was used in place of the thermoplastic polyamide, and evaluated as in Example 1.

Example 4

In Example 4, an intermediate transfer belt having a volume resistance of $1.4\times10^{9}$ Ω·cm and a surface resistance of $5.4\times10^{10}$ Ω/□was produced in the same manner as in Example 2 except that 100 parts by weight of polybutylene terephthalate and 20 parts by weight of polycarbonate were used in place of the thermoplastic polyamide and the thermoplastic elastomer and also the content of acetylene black was changed to 20 parts by weight, and evaluated as in Example 1.

Example 5

In Example 5, an intermediate transfer belt was produced in the same manner as in Example 1 except that the content of acetylene black in the intermediate transfer belt was changed to 35 parts by weight and its dispersion conditions were changed, and evaluated as in Example 1.

Additionally, the volume resistance was $7.2\times10^{8}$ Ω·cm and the surface resistance, of the intermediate transfer belt, was $9.0\times10^{9}$Ω/□.

Example 6

In Example 6, an intermediate transfer belt was produced in the same manner as in Example 2 except that the content of the thermoplastic elastomer in the intermediate transfer belt was changed to 25 parts by weight and also the content of acetylene black was change to 38 parts by weight and also the dispersion conditions were changed, and evaluated as in Example 2.

Additionally, the volume resistance was $6.3\times10^{8}$ Ω·cm and the surface resistance, of the intermediate transfer belt, was $4.1\times10^{9}$ Ω/□.

Comparative Example 1

In Comparative Example 1, an intermediate transfer belt was produced in the same manner as in Example 1 except that the content of acetylene black in the intermediate transfer belt was changed to 15 parts by weight and its dispersion conditions were changed, and evaluated as in Example 1.

Additionally, the volume resistance was $2.5\times10^{11}$ Ω·cm and the surface resistance, of the intermediate transfer belt, was $3.4\times10^{12}$ Ω/□.

Comparative Example 2

In Comparative Example 2, an intermediate transfer belt was produced in the same manner as in Example 2 except that the content of acetylene black in the intermediate transfer belt was changed to 35 parts by weight and its dispersion conditions were changed, and evaluated as in Example 2.

Additionally, the volume resistance was $6.7\times10^{6}$ Ω·cm and the surface resistance, of the intermediate transfer belt, was $8.2\times10^{7}$ Ω/□.

Comparative Example 3

In Comparative Example 3, an intermediate transfer belt was produced in the same manner as in Example 3 except that the content of acetylene black in the intermediate transfer belt was changed to 15 parts by weight and its dispersion conditions were changed, and evaluated as in Example 3.

Additionally, the volume resistance was $1.5\times10^{11}$ Ω·cm and the surface resistance, of the intermediate transfer belt, was $1.1\times10^{12}$ Ω/□.

Comparative Example 4

In Comparative Example 4, an intermediate transfer belt was produced in the same manner as in Example 3 except that the content of acetylene black in the intermediate transfer belt was changed to 40 parts by weight and its dispersion conditions were changed, and evaluated.

Additionally, the volume resistance was $8.8\times10^{6}$ Ω·cm and the surface resistance, of the intermediate transfer belt, was $9.5\times10^{7}$ Ω/□.

TABLE 1

| | Intermediate transfer belt | | | | | | Evaluation | | | |
|---|---|---|---|---|---|---|---|---|---|---|
| | | | | | | | Density difference evaluation | | Central fade-out occurrence evaluation | |
| | Resin composition | | Acetylene black | Volume resistance | Surface resistance | R1/R2 | Density | | Central fade-out | |
| | Kind | Weight part | (weight part) | R1 (Ω · cm) | R2 (Ω/□) | (Ω · cm/(Ω/□)) | difference (−) | Result | occurrence rate (%) | Result |
| Example 1 | Nylon 12 | 100 | 25 | $1.2\times10^{9}$ | $3.4\times10^{10}$ | 0.035 | 0.11 | Very good | 5 | Very good |
| Example 2 | Nylon 12/ PA12 Elastomer | 100/20 | 30 | $1.5\times10^{9}$ | $5.2\times10^{10}$ | 0.029 | 0.12 | Very good | 6 | Very good |
| Example 3 | Polyfluorinated vinylidene | 100 | 25 | $1.2\times10^{9}$ | $1.1\times10^{10}$ | 0.109 | 0.25 | Fair | 11 | Fair |
| Example 4 | Polybutylene terephthalate/ polycarbonate | 100/20 | 20 | $1.4\times10^{9}$ | $5.4\times10^{10}$ | 0.026 | 0.28 | Fair | 12 | Fair |
| Example 5 | Nylon 12 | 100 | 35 | $7.2\times10^{8}$ | $9.0\times10^{9}$ | 0.080 | 0.20 | Good | 7 | Good |
| Example 6 | Nylon 12/ PA12 Elastomer | 100/25 | 38 | $6.3\times10^{8}$ | $4.1\times10^{9}$ | 0.154 | 0.24 | Good | 7 | Good |
| Comparative Example 1 | Nylon 12 | 100 | 15 | $2.5\times10^{11}$ | $3.4\times10^{12}$ | 0.074 | 0.41 | Bad | 8 | Good |
| Comparative Example 2 | Nylon 12/ PA12 Elastomer | 100/20 | 35 | $6.7\times10^{6}$ | $8.2\times10^{7}$ | 0.082 | 0.45 | Bad | 9 | Good |
| Comparative Example 3 | Polyfluorinated vinylidene | 100 | 15 | $1.5\times10^{11}$ | $1.1\times10^{12}$ | 0.136 | 0.40 | Bad | 15 | Bad |
| Comparative Example 4 | Polyfluorinated vinylidene | 100 | 40 | $8.8\times10^{6}$ | $9.5\times10^{7}$ | 0.092 | 0.38 | Bad | 15 | Bad |

According to an image forming device and an image forming method using the image forming device, related to the present invention, even where a photoconductor drum and a transfer roller are offset placed, the image forming device particularly excellent in transferability of color toner particles and capable of effectively restraining the generation of so-called central fade-out and the image forming method using the image forming device can have been provided.

Thus, the image forming device and the image forming method using the image forming device of the present invention are expected to extremely contribute to the improvement of image characteristics in a variety of image forming devices such as a color copying machine and a color printer.

What is claimed is:

1. An image forming device, comprising:

an image support body on which an electrostatic latent image is formed;

a developer which develops the electrostatic latent image formed on the image support body with a toner to form a toner image;

an intermediate transfer belt onto which the toner image formed on the image support body is transferred;

a primary transfer means for transferring the toner image on the image support body onto the intermediate transfer belt; and a secondary transfer means for transferring the toner image on the intermediate transfer belt onto paper, the image support body and the primary transfer means being offset placed, wherein a volume resistance of the intermediate transfer belt is adjusted to a value within the range of from $1\times10^{7}$ to $1\times10^{11}$ Ω·cm and a surface resistance of the intermediate transfer belt is adjusted to a value within the range of from $1\times10^{8}$ to $1\times10^{12}$ Ω/□, and wherein the intermediate transfer belt is constituted by a resin composition including a polyamide resin, a thermoplastic elastomer and an electroconductive material, and an addition quantity of the thermoplastic elastomer is adjusted to a value within the range of from 10 to 150 parts by weight based on 100 parts by weight of the polyamide resin and an addition quantity of the electroconductive material is adjusted to a value within the range of from 0.1 to 100 parts by weight based on the amount of resin composition.

2. The image forming device according to claim 1, wherein when R1 denotes the volume resistance of the intermediate transfer belt and R2 denotes the surface resistance of the intermediate transfer belt, a numerical value represented by R1/R2 is adjusted to a value within the range of from 0.01 to 100 (Ω·/(Ω/□)).

3. The image forming device according to claim 1, wherein when the toner is transferred, a current flowing between the image support body and the primary transfer means is adjusted to a value within the range of from 0.1 to 50 μA.

4. The image forming device according to claim 1, wherein a modulus of elasticity of the intermediate transfer belt is adjusted to a value within the range of from $1\times10^{1}$ to $1\times10^{3}$ MPa.

5. The image forming device according to claim 1, wherein a surface roughness (Rz) of the intermediate transfer belt is adjusted to a value of less than 1.5 μm.

6. The image forming device according to claim 1, wherein a thickness of the intermediate transfer belt is adjusted to a value within the range of from 50 to 200 μm.

7. The image forming device according to claim 1, wherein the thermoplastic elastomer is a polyamide-base thermoplastic elastomer.

8. The image forming device according to claim 1, wherein the resin composition contains a compatibilizing agent between a polyamide resin and a thermoplastic elastomer.

9. The image forming device according to claim 1, wherein the image support body is an amorphous silicon drum.

10. The image forming device according to claim 1, wherein the toner is a positively charged toner.

11. An image forming method in an image forming device comprising: an image support body on which an electrostatic latent image is formed; a developer which develops the electrostatic latent image formed on the image support body with a toner to form a toner image; an intermediate transfer belt onto which the toner image formed on the image support body is transferred; a primary transfer means for transferring the toner image on the image support body onto the intermediate transfer belt; and a secondary transfer means for transferring the toner image on the intermediate transfer belt onto paper, the image support body and the primary transfer means being offset placed, wherein a volume resistance of the intermediate transfer belt is adjusted to a value within the range of from $1\times10^{7}$ to $1\times10^{11}$ Ω·cm and a surface resistance of the intermediate transfer belt is adjusted to a value within the range of from $1\times10^{8}$ to $1\times10^{12}$ Ω/□, and wherein the intermediate transfer belt is constituted by a resin composition including a polymide resin, a thermoplastic elastomer and an electroconductive material, and an addition quantity of the thermoplastic elastomer is adjusted to a value within the range of from 10 to 150 parts by weight based on 100 parts by weight of the polyamide resin and an addition quantity of the electroconductive material is adjusted to a value within the range of from 0.1 to 100 parts by weight based on the amount of resin composition.

* * * * *